US005263213A

United States Patent [19]

Robertson et al.

[11] Patent Number: 5,263,213

[45] Date of Patent: Nov. 23, 1993

[54] PATIENT SUPPORT SURFACE THAT INCLUDES FOLDABLE SEGMENTS MADE OF COMPOSITE MATERIAL

[75] Inventors: A. Scott Robertson, San Francisco; Richard Geiger, Alameda; Neville Page, San Francisco, all of Calif.

[73] Assignee: Medical Composite Technology, Inc., Soquel, Calif.

[21] Appl. No.: 874,129

[22] Filed: Apr. 27, 1992

Related U.S. Application Data

[63] Continuation-in-part of Ser. No. 789,173, Nov. 8, 1991.

[51] Int. Cl.[5] ..... A61G 1/00

[52] U.S. Cl. ..... 5/627; 5/620; 5/625; 5/601

[58] Field of Search ..... 5/625, 627, 601, 620, 5/81.1, 89.1

[56] References Cited

U.S. PATENT DOCUMENTS

| | | | |
|---|---|---|---|
| 261,796 | 7/1882 | Wells | 5/627 |
| 362,057 | 5/1887 | Blood . | |
| 2,059,957 | 11/1936 | Mendenhall et al. . | |
| 2,133,692 | 10/1938 | Gittings | 5/627 |
| 2,350,573 | 6/1944 | Smith | 5/627 |
| 2,362,721 | 11/1944 | Reynolds . | |
| 2,454,802 | 11/1948 | Hipps . | |
| 3,151,343 | 10/1964 | McCormick | 5/627 |
| 3,247,529 | 4/1966 | Benton . | |
| 3,343,180 | 9/1967 | Lothschuetz . | |
| 3,414,914 | 12/1968 | Gramins | 5/627 |
| 3,449,776 | 6/1969 | Brock . | |
| 3,648,305 | 3/1972 | Ersek | 5/625 |
| 3,721,434 | 3/1973 | Spies . | |
| 4,103,170 | 7/1978 | Spradlin . | |
| 4,193,148 | 3/1980 | Rush . | |
| 4,197,464 | 4/1980 | Amor . | |
| 4,566,445 | 1/1986 | Jelsma | 5/625 |
| 4,584,729 | 4/1986 | Roberts et al. . | |
| 4,627,428 | 12/1986 | Brooks | 5/625 |
| 4,669,136 | 6/1987 | Waters et al. . | |
| 4,783,862 | 11/1988 | Murphy . | |
| 4,794,656 | 1/1989 | Henley, Jr. . | |
| 4,841,961 | 6/1989 | Burlage et al. . | |
| 4,922,562 | 5/1990 | Allred et al. . | |
| 4,926,457 | 5/1990 | Poehner et al. . | |
| 4,928,711 | 5/1990 | Williams . | |
| 4,943,041 | 7/1990 | Romein . | |
| 4,945,583 | 8/1990 | Schnitzler . | |
| 4,947,418 | 8/1990 | Barr et al. . | |
| 4,956,885 | 9/1990 | Alich et al. . | |
| 5,121,514 | 6/1992 | Rosane | 5/625 |
| 5,138,731 | 8/1992 | Harcrow | 5/627 |

FOREIGN PATENT DOCUMENTS

| | | | |
|---|---|---|---|
| 91491 | 2/1938 | Sweden | 5/627 |

*Primary Examiner*—Peter M. Cuomo
*Assistant Examiner*—Flemming Saether
*Attorney, Agent, or Firm*—Burns, Doane, Swecker & Mathis

[57] ABSTRACT

A multipurpose patient support surface is provided with support surface segments connected to one another in series. The segments are formed of a sandwich laminate including a top and a bottom load bearing skin layer separated by a core material. The segments are connected to one another at transverse edges by a hinge area and are locked in position relative to one another to form substantially planar support surface.

32 Claims, 9 Drawing Sheets

PATIENT SUPPORT SURFACE THAT INCLUDES FOLDABLE SEGMENTS MADE OF COMPOSITE MATERIAL

CROSS REFERENCE TO RELATED APPLICATIONS

The present application is a continuation-in-part of U.S. patent application Ser. No. 07/789,173, filed on Nov. 8, 1991.

BACKGROUND

The present invention relates to a patient support surface and, more particularly, to a patient support surface that is adaptable to multiple uses in medical and other emergency settings.

A variety of devices are used in hospitals and similar settings for supporting a prone patient. When an individual is injured, emergency teams often use a collapsible stretcher to carry the individual to treatment. If the injury involves a spinal or other injury requiring immobilization of the individual, a more rigid device such as a backboard is usually used. Both stretchers and backboards are generally formed with handles or holes for holding the device.

Once a patient is at a hospital, it is usually necessary to move the patient from the stretcher or backboard to other support surfaces such as wheeled gurneys or fixed beds, operating tables, and x-ray and CAT scan machines. Especially if the patient has spinal or unascertained internal injuries, each move to a new support surface involves potentially serious aggravation of the injury. It is therefore desirable to be able to adapt a single patient support surface to more than a single use.

In addition to the desirability of being able to adapt patient support surfaces to a variety of purposes, most patient support surfaces have common desirable physical characteristics. Great structural rigidity is important in such devices, as noted, for example, in Alich et al. U.S. Pat. No. 4,956,885, which describes a patient support comprising a fiber-reinforced epoxy resin core with a coating being provided thereon, and which is incorporated herein by reference. Light weight and, preferably, buoyancy, is desirable, especially in field stretchers where it may be necessary to float an injury victim across a body of water. Benton U.S. Pat. No. 3,247,529, for example, discloses a litter bed formed from foamed-in-place, expanded foam plastic which is foamed into a plastic envelope of a desired size and is allowed to set. Further, the ability to collapse the patient support surface prior to and following use, such that it takes up relatively little space, is highly desirable. To this end, solutions have included those shown by Brock U.S. Pat. No. 3,449,776, which describes a patient support surface including telescoping segments, and Poehner et al. U.S. Pat. No. 4,926,457, which describes a patient support surface having hinged segments foldable relative to one another, and which is described in more detail below.

In recognition of the desirability of multipurpose patient support surfaces, multipurpose devices such as the radiolucent hospital bed surface described in Poehner et al., which is incorporated herein by reference, and the transparent radiation penetrable stretcher panel described in Rush U.S. Pat. No. 4,193,148 have been devised. The surface described by Poehner et al. is a lightweight, multipurpose rigid surface adapted for use in x-ray machines and the like and has hinged joints for folding the surface when not in use. The surface comprises a synthetic sheet-like patient support element and an underlying synthetic corrugated reinforcing element spaced apart from the support element. The surface described by Rush, which is incorporated herein by reference, is a transparent panel, permeable or penetrable to x-rays, formed of flexible plastics material and riveted to a rigid rectangular perimeter frame.

As noted in the Poehner et al. patent, multipurpose support surfaces intended for use in x-ray, fluoroscopy, or "C"-arm mounted diagnostic or treatment equipment must comply with the United States Food and Drug Administration (F.D.A.) standard wherein surfaces lying in a wave path must produce no more attenuation than a Series 1100 aluminum sheet that is one millimeter thick ("F.D.A. one millimeter standard"). Accordingly, material selection for such applications has often been limited to thin skins of aluminum riveted over a frame or a variety of sheet plastics. Most of these materials do not generally stand up well to excessive loading situations in that rivet holes become elongated and material fatigue causes surface failures. Further, cleaning of such surfaces is made difficult where blood or other foreign matter becomes trapped in and around rivets, material joints, and hinge areas.

SUMMARY

In accordance with one aspect of the present invention, a patient support surface is provided, having a first support surface segment connected to a second support surface segment on a transverse edge of the first support surface segment and a transverse edge of the second support surface segment. The support surface segments each have two transverse and two longitudinal edges and are rigid in a transverse and a longitudinal direction.

The patient support surface is further provided with means for folding the first support surface segment relative to the second support surface segment, in a longitudinal direction, at the connection at the transverse edges of the support surface segments. The folding means comprise a flexible hinge area extending between the transverse edges of the support surface segments, an interior area of the flexible hinge area being isolated from the environment. The patient support surface is provided with means for locking the support surface segment relative to the another support surface segment, at the at least one transverse edge of the support surface segments, to form a substantially planar support surface having a top and a bottom planar surface and four corners. The support surface segments are formed of a laminate material including a top and a bottom load bearing skin layer, each having exterior and interior surfaces, at least a portion of each support surface segment being formed of a sandwich laminate comprising the top and bottom load bearing skin members being separated by a core in contact with the interior surfaces.

In a further aspect, the folding means comprise transverse portions of the interior surfaces of the top and bottom skin layers that are sealed together.

In a further aspect, the locking means comprise a longitudinal recessed area in the core of the first support surface segment and the second support surface segment, the recessed area crossing the connection at the at least one transverse edge of the support surface segments, and a rigid bar. The rigid bar is receivable in and longitudinally slidable in the recessed area. The recess in the core of at least one of the support surface segments is at least as long as the bar.

In a further aspect, the locking means comprise a rigid C-shaped member, the C-shaped member fitting over the longitudinal edges of the support surface segments. The C-shaped member is longitudinally slidable across the connection at the transverse edges of the support surface segments.

In a further aspect, the locking means comprise a recessed area in the core of the second support surface segment, and a rigid bar pivotably attached to the core of the first support surface segment. The rigid bar is pivotable into and out of the recess in the core of the another support surface segment.

In a further aspect, the patient support surface further comprises a patient transfer sheet. The patient transfer sheet is substantially rectangular and substantially as large as the planar support surface. The patient transfer sheet has four corners formed to attach over the four corners of the planar support surface for holding the patient transfer sheet in position relative to the planar support surface.

In a further aspect, at least a portion of each support surface segment is formed of a honeycomb material.

In a further aspect, at least a portion of each support surface segment is formed of composite material comprising fiber reinforcing elements oriented to provide rigidity in one direction and flexibility in another.

BRIEF DESCRIPTION OF THE DRAWINGS

The features and advantages of the present invention will be well understood by reading the following detailed description in conjunction with the drawings in which like numerals indicate similar elements and in which.

DETAILED DESCRIPTION

Figure 1:
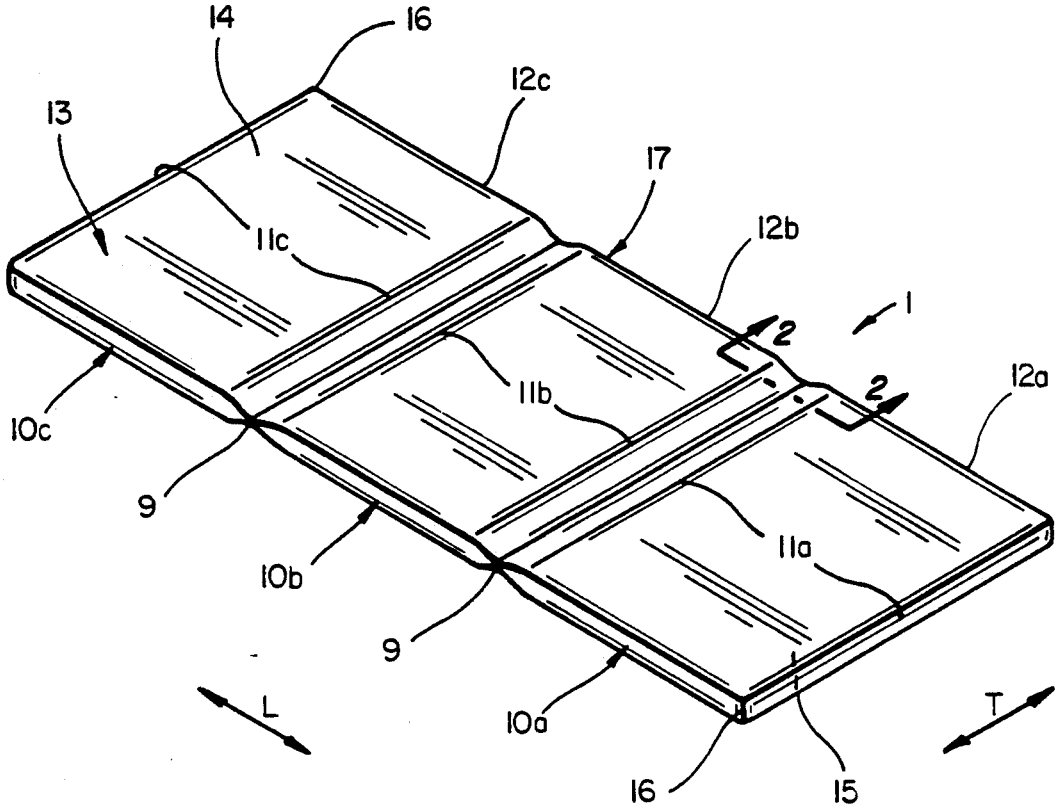
FIG. 1 is a perspective view of a patient support surface according to an embodiment of the present invention.
Figure 2:
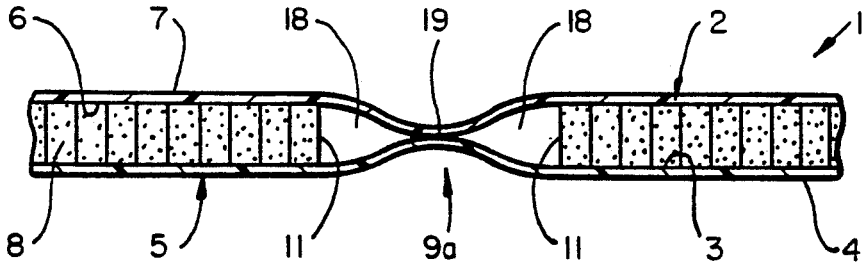
FIG. 2 is a side cross-sectional view taken at section 2—2 of FIG. 1.

With reference to FIGS. 1, 2, 3, and 18, an embodiment of a patient support surface 1 includes a top skin layer 2 and a bottom skin layer 5 sandwiching a core material 8. The top skin layer 2 has an interior surface 3 and an exterior surface 4 and the bottom skin layer 5 has an interior surface 6 and an exterior surface 7. The core material 8 is laminated to the interior surfaces 3 and 6 of the top and bottom skin layers.

Figure 8:
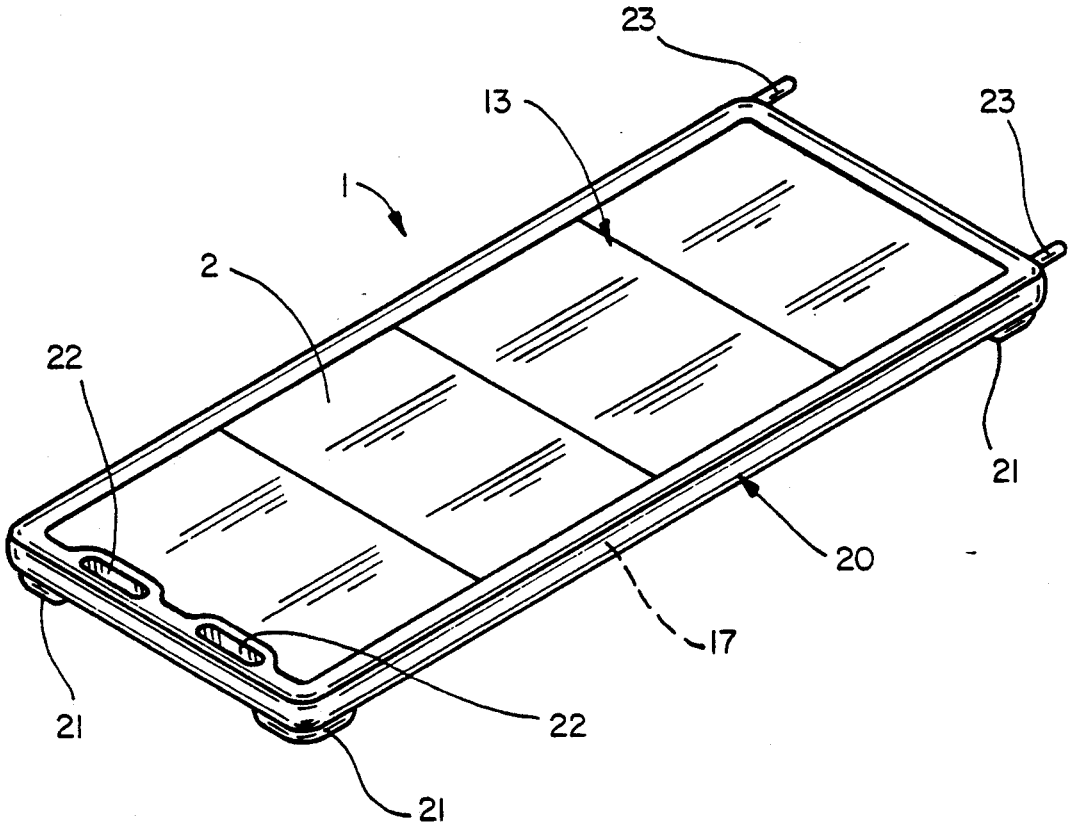
FIG. 8 is a perspective view of a patient support surface according to an embodiment of the present invention.

The patient support surface 1 comprises one or more support surface segments 10 connected to another support surface segment 10 at a transverse edge 11 of each of the segments 10. The patient support surface 1 shown in FIG. 1 depicts a preferred embodiment in which three segments 10*a*, 10*b*, and 10*c* are connected at transverse edges such that a transverse edge 11*a* of the segment 10*a* is connected to a transverse edge 11*c* of the segment 10*c*, and a transverse edge 11*b* of the segment 10*b* is connected to another transverse edge 11*c* of the segment 10*c*. Any desired number of segments 10 may, of course, be connected to one another in series. For instance, four segments 10 are shown in FIG. 8. In another embodiment of the present invention, a single segment forms the patient support surface (not shown).

The individual segments 10 may be formed to be rigid in a transverse direction T and a longitudinal direction L as a result of the top skin layer 2, core 8, and bottom skin layer 5 sandwich laminate or other structures that will be described below. The individual top and bottom skin layers 2, 5 are preferably flexible, yet able to bear a load, and transparent and made of a material that meets the F.D.A. one millimeter standard, such as commercially available composite materials, one such product being that described by Rush, which, as noted above, is incorporated by reference, and which describes a material as being made and manufactured under the trademark TUFFAX, others being those described by Alich et al. and Poehner et al., which, as noted above, are incorporated by reference. Also, an aluminum skin may be formed to meet the F.D.A. one millimeter standard. As will be made clear below, however, the above criteria are not essential to practice of the present invention.

Figure 3:
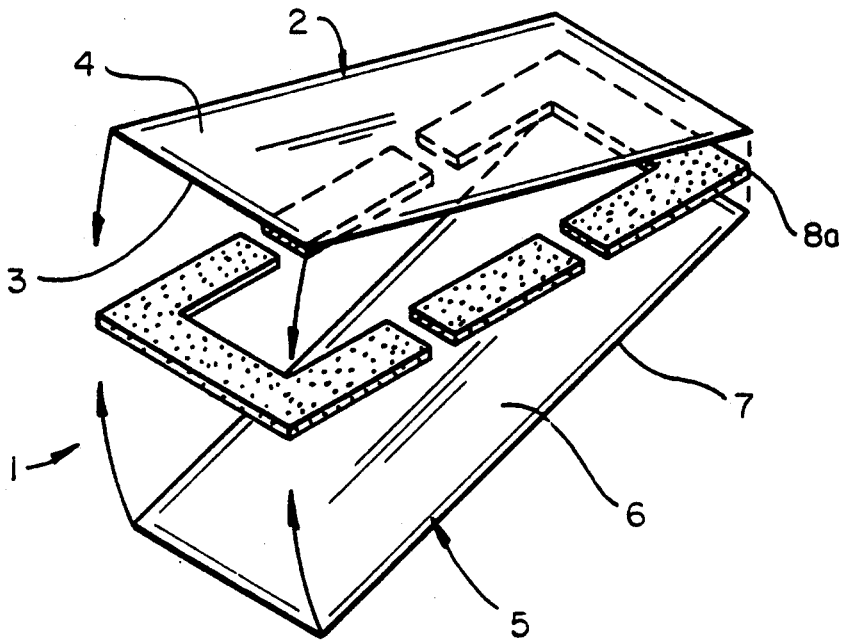
FIG. 3 is an exploded perspective view of a patient support surface according to an embodiment of the present invention.
Figure 18:
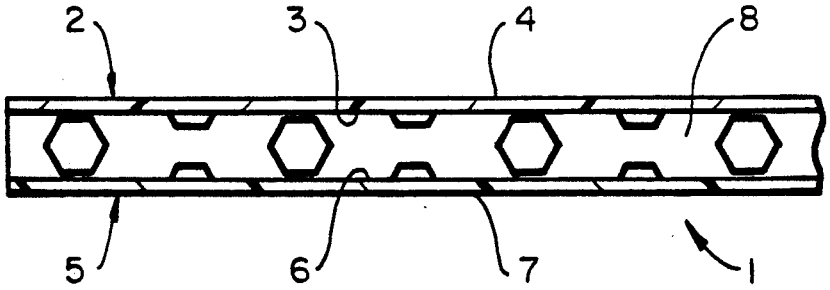
FIG. 18 is a cross sectional view of a laminate material according to an embodiment of the present invention.

The core 8 may be located around only the periphery of the patient support surface 1, which is preferred for use of the patient support surfaces intended to meet the F.D.A. one millimeter standard and which is shown in the exploded view of FIG. 3. However, the core may also be provided around the periphery of individual segments 10, or may extend across entire segments (not shown), either of which structures will be preferred for uses requiring heightened rigidity characteristics of a patient support surface. The core 8 is preferably formed from a lightweight composite honeycomb material such as are commercially available, and such as is shown in FIG. 18. A metallic honeycomb material, such as an aluminum honeycomb, or an expanded or foamed composite material also provide light weight core materials, and many additional core materials, such as those described in Alich et al., have sufficient structural rigidity for the intended purpose of the patient support surface and are also available. Depending upon material selection for the skin layers 2, 5, it may also be desirable to use a flexible core 8 if the skin layers can provide the necessary rigidity for the particular application of the patient support surface.

Figure 19A:
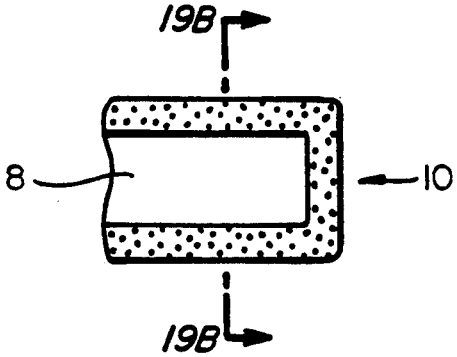
FIGS. 19A and 19B are cross sectional views of a hollow composite material having oriented fiber reinforcing elements according to an embodiment of the present invention.
Figure 19B:
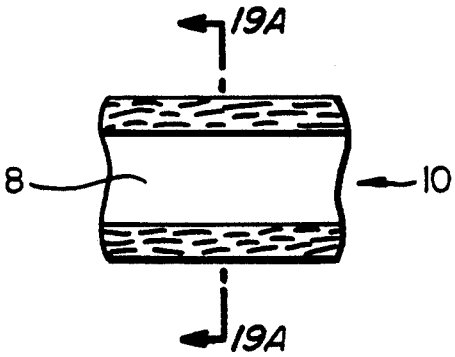

Anisotropic fiber reinforced plastic is also known to be a useful material for light weight, high strength applications. Several layers of such materials may be oriented to provide flexibility in one direction and rigidity in another direction, such as a transverse direction of a segment 10. Trimble U.S. Pat. Nos. 4,850,607, 4,889,355, 4,902,458, 4,923,203, and 4,941,674, which are incorporated herein by reference, relate to the use of composite materials comprising fiber reinforcing elements oriented to provide rigidity in one direction and flexibility in another direction and which materials have application in portions of the segments 10. The anisotropic fiber reinforced plastic is particularly useful as a top and bottom skin layer 2, 5. Further, anisotropic fiber reinforced plastic may be manufactured in a hollow form, as shown in FIGS. 19A and 19B, to be used, for example, as part of a core 8. One such material that is available commercially is sold under the trademark COMFLEX. In short, all of the materials listed above are considered to be highly useful in portions of the segments 10.

The skin layers 2, 5 and the core 8 may be laminated together by any process that will isolate the interior of the patient support surface from the environment. Such processes include ultrasonic bonding of materials and joining with adhesives.

Figure 4:
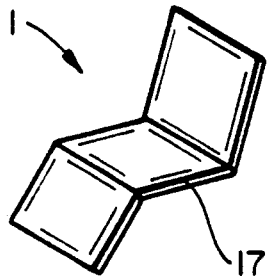
FIG. 4 is a perspective view of a partially folded patient support surface according to an embodiment of the present invention.
Figure 5:
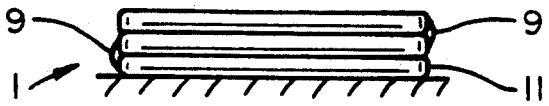
FIG. 5 is a side view of a completely folded patient support surface according to an embodiment of the present invention.

When the patient support surface 1 is in an unfolded state, such as is shown in FIGS. 1, 6, 8, 9, 11, and 17, it forms a planar support surface 13 such that the segments 10 are substantially in the same plane. The segments 10 are connected to one another at their transverse edges 11 by a hinge area 9. The hinge area 9 extends between the transverse edges 11 and forms an environmentally isolated connection with the segments 10, such that the external environment is prevented from entering and contaminating the interior 18 of the hinge area and the patient support surface 1. As can best be seen in the preferred embodiment of the hinge area **9*a* in FIG. 2, the hinge area may comprise portions of a patient support surface 1 comprising a single top sheet layer 2 and a single bottom sheet layer 3, such as is shown in FIG. 3, between which no core material 8 is provided, the interior surfaces 3, 6 of the top and bottom sheet layers 2, 5 being connected at a sealed area 19. The sealed area 19 may be formed by such processes as joining with an adhesive or by ultrasonic bonding. The hinge area 9 is flexible and permits folding of the patient support surface 1, such as is shown, for example, in FIGS. 4 and 5**, to collapse the patient support surface into a more compact form.

Figure 6:
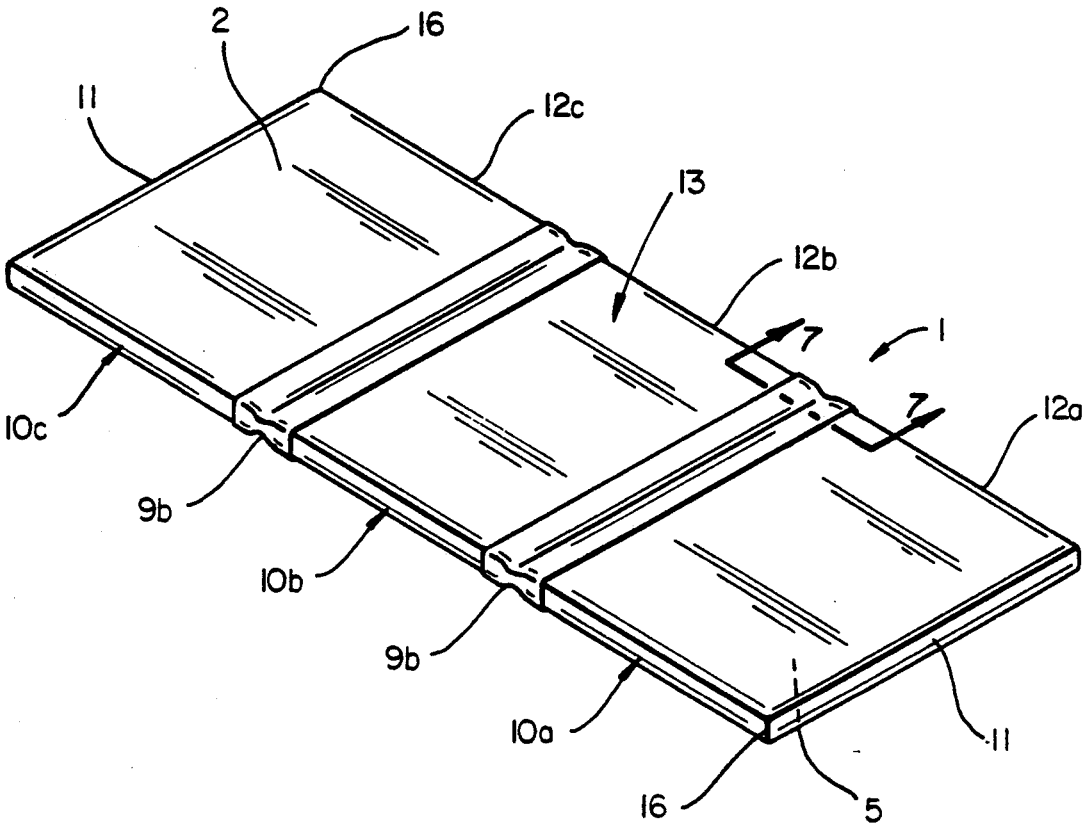
FIG. 6 is a perspective view of a patient support surface according to an embodiment of the present invention.
Figure 7:
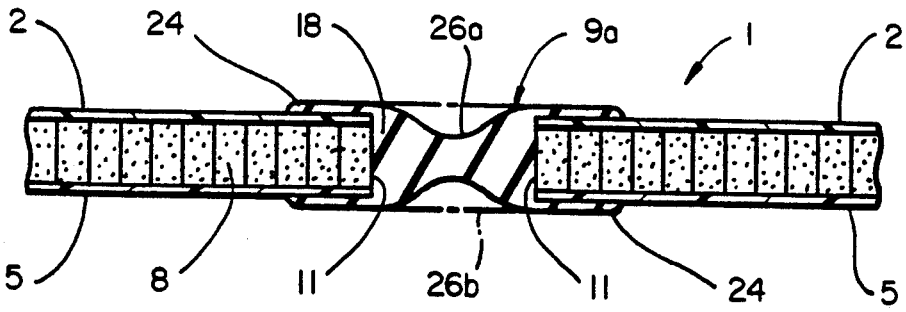
FIG. 7 is a side cross sectional view at section 7—7 of the patient support surface of FIG. 6.

As seen best by FIGS. 6 and 7, the patient support surface 1 may comprise segments **10*a*, 10*b*, and 10*c*, each having top and bottom sheet layers 2, 5 separated by core material and connected by hinge areas 9*b*. The hinge area 9*b* includes flange portions 24 extending past and connected to the transverse edges 11 and forms an environmentally isolated connection with the segments 10, such that the external environment is prevented from entering and contaminating the interior 18 of the hinge area and the patient support surface 1. The hinge area 9*b* is preferably formed of a flexible material such as rubber to permit bending of the hinge area at a middle area 26. The hinge area 9*b* may be formed to have a substantially uniform thickness, as is shown in FIG. 7 by dashed lines 26*b*, but is preferably formed to have a reduced thickness middle area 26*a* to facilitate bending of the hinge area at the middle area 26*a*, thereby reducing stress on the connection between the hinge portion 9*b* and the segments 10**.

The hinge area **9*b* is generally attached to the exterior surfaces 4, 7 of the top and bottom skin layers 2, 5 such that a portion of the core 8 is sandwiched between the flanges 24 of the hinge portion and the top and bottom sheet layers 2, 5, such as is shown in FIG. 7. However, the core 8 may also be removed from between the top and bottom sheet layers 2, 5, such that the interior portions 3, 6 of the sheet layers are adjacent one another and sandwiched between the flanges 24 (not shown). The hinge area 9*b*** need not, in the latter structure, be independently flexible, provided flexible sheet layer material is provided to permit a folding function by the hinge area.

Figure 9:
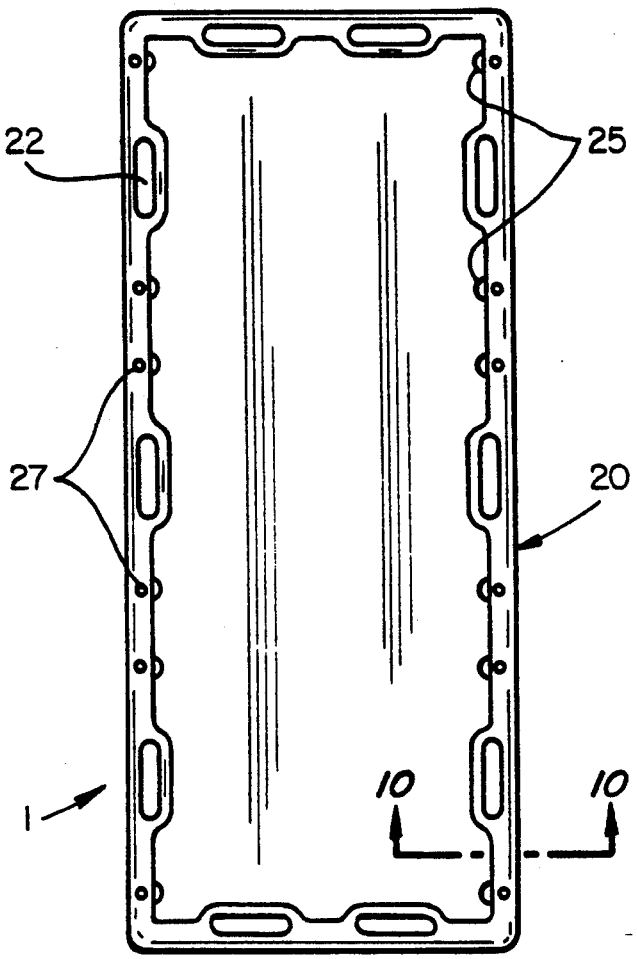
FIG. 9 is a top view of a patient support surface according to an embodiment of the present invention.
Figure 10:
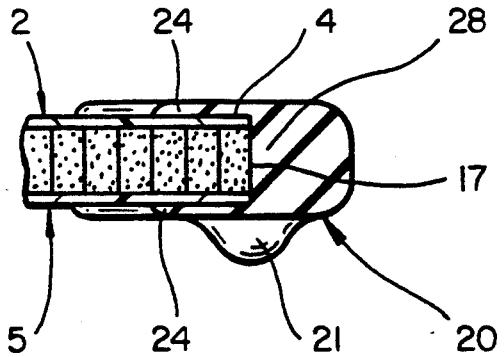
FIG. 10 is a cross sectional view at section 10—10 of the patient support surface of FIG. 9.

The patient support surface 1 is unfolded to form the substantially rectangular planar support surface 13, in which form the patient support surface has a planar top surface 14, a planar bottom surface 15, four corners 16, and a periphery 17. However, as the patient support surface 1 is folded, as is seen, for example, in FIGS. 4 and 5, the shape of the periphery 17 is varied, additional corners are formed, and the top and bottom surfaces 14, 15 are no longer planar. As shown in FIGS. 8, 9, and 10, flexible trim 20 that bends with the patient support surface 1 may be provided around the periphery 17 to protect the patient support surface, as well as to protect surfaces with which it comes into contact.

The trim 20 may be provided with feet 21 by the top and bottom surfaces 14, 15 of the patient support surface 1 to provide a space between the patient support surface and a surface upon which the patient support surface is rested to facilitate lifting or movement of the patient support surface. The trim may be further provided with hand holds in the form of holes 22 or grips 23. The periphery 17 of the patient support surface 1 may be formed with recesses 25 at areas such that through holes 27 are formed between the trim 20 and the periphery 17. The through holes 27, or the recesses 25 alone, facilitate adaptation of the patient support surface to various purposes such as attachment to pre-existing frames for beds, gurneys, ambulances, and x-ray tables or the like by connecting the patient support surface to those frame by means such as straps (not shown). Further, the patient support surface 1 may be formed such that it may be placed in a variety of transport devices such as the above-mentioned frames by those devices being adapted to receive a patient support surface of a predetermined shape. The through holes 27 or the recesses 25 alone are further useful for strapping a load to the patient support surface.

Preferably, a patient support surface 1 is manufactured without the use of any metals. Such a non-metallic patient support surface is adapted to be used in Magnetic Resonance Imaging (MRI) apparatuses without interfering with the performance of such apparatuses. The above-described composite and plastic materials are well-suited for manufacturing a non-metallic patient support surface, with or without the above-described hinge areas 9 and, correspondingly, with or without the below-described locking apparatuses 30.

The trim 20 is preferably formed from the same material as the hinge area 9*b*, if any, and is connected to the periphery 17 in a similar manner to that of the hinge area 9*b*. The trim 20 includes flange portions 24 extending past and connected to the longitudinal and transverse edges 10, 11 defining the periphery 17 of the patient support surface 1 and forms an environmentally isolated connection with the patient support surface, such that the external environment is prevented from entering and contaminating the interior 28 of the trim 20 and the patient support surface 1. The trim 20 may be formed integrally with hinge areas 9*b*, if any. The trim 20, and, if any, the hinge areas 9*b*, may be sufficiently flexible as to be fitted around the segments 10, or may be built around the segments, such as by joining together a top and a bottom portion (not shown) of the trim.

Figure 11:
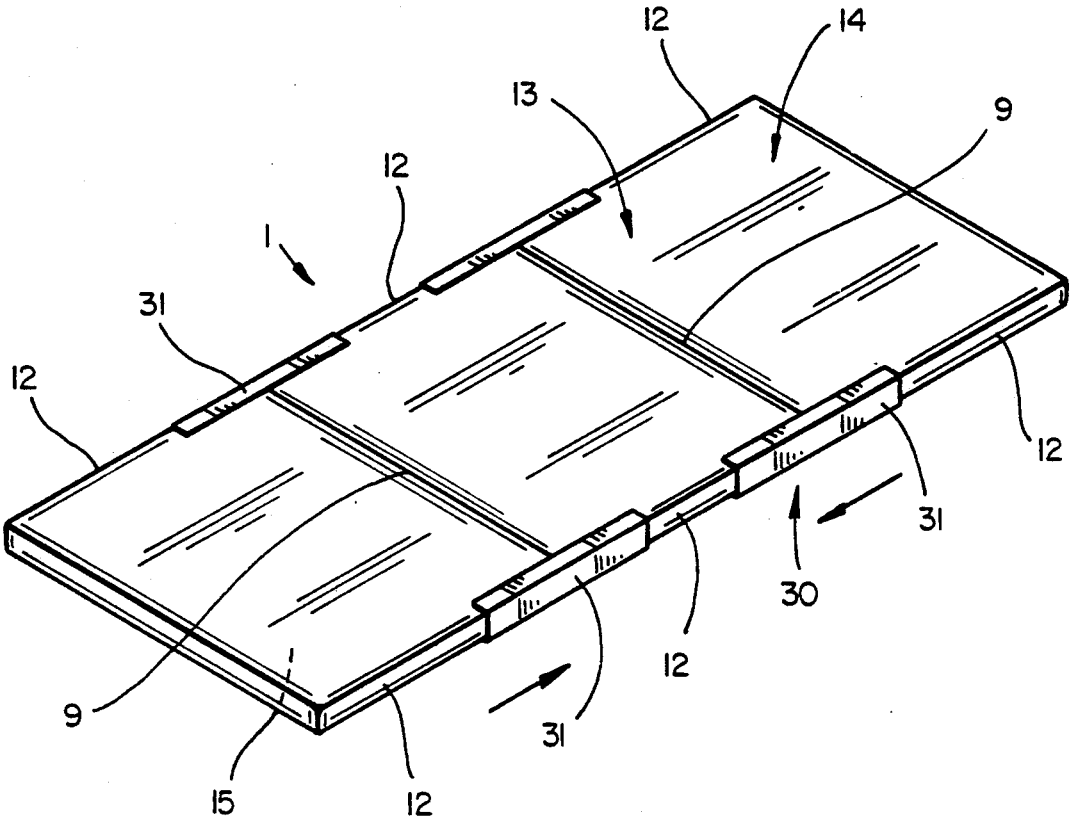
FIG. 11 is a perspective view of a patient support surface with a locking structure according to an embodiment of the present invention.
Figure 12:
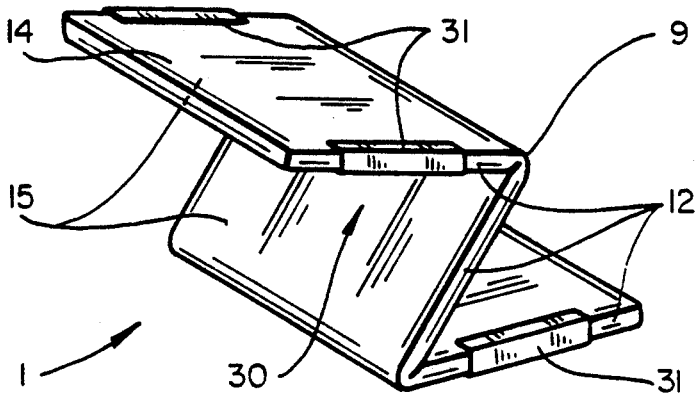
FIG. 12 is a perspective view of a partially folded patient support surface with a locking structure according to an embodiment of the present invention.

With reference to FIGS. 11 and 12, an embodiment of a locking apparatus 30 for locking a patient support surface 1 to form a planar support surface 13 includes a lock out slider 31. The lock out slider 31 is a substantially C-shaped tubular member that is positioned over the longitudinal edges 12 of the segments 10 and is slidable, longitudinally, across transverse edges 11 of successive segments and hinge areas 9 to brace the successive segments in substantially the same plane. Preferably, two lock out sliders 31 are provided across each hinge area 9 on opposing longitudinal edges of the patient support surface I.

The lock out sliders 31 may be fitted over longitudinal edges 12 that are provided with trim 20, such that the interior of the tips of the "C" of the lock out sliders abut a raised interior peripheral area of the trim, such as that shown in FIG. 10, and are prevented from moving transversely. However, the lock out sliders 31 may also be fitted over longitudinal edges 12 that are not provided with trim, such as is shown in FIG. 11. In the latter situation, the peripheral area of the top and bottom surfaces 14, 15 near the longitudinal edges 12 of the segments 10 may be formed with recesses (not shown) for preventing transverse movement of the lock out sliders.

The lock out sliders 31 may, of course, simply be fitted over the longitudinal edges 12 without providing any recess or trim. It is preferable, in this situation, to form the lock out sliders 31 such that a tight fit exists between a lock out slider and the longitudinal area 12, or such that a high coefficient of friction exists between the lock out slider and the exterior surfaces 4, 7 of the top and bottom sheet layer 2, 5, or both.

Figure 13:
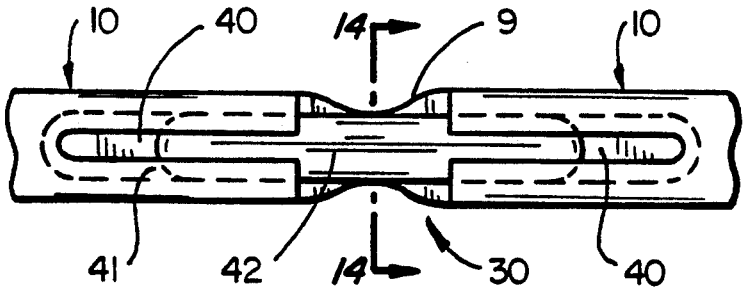
FIG. 13 is a side view of a locking structure according to an embodiment of the present invention.
Figure 14:
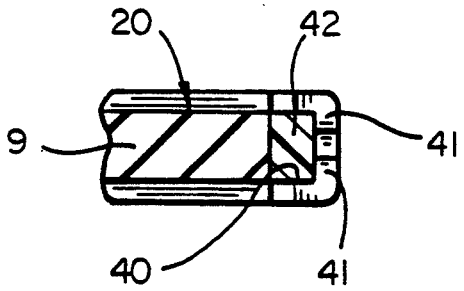
FIG. 14 is a cross sectional view taken at section 14—14 of the locking structure of FIG. 13.
Figure 15:
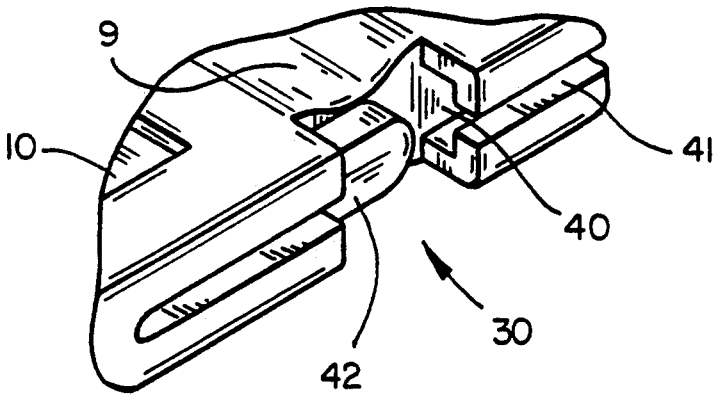
FIG. 15 is a perspective view of a locking structure according to an embodiment of the present invention.

With reference to FIGS. 13, 14, and 15, another embodiment of the locking apparatus 30 includes a recessed area 40, the recessed area having a lip 41 partially closing the recess, formed in the longitudinal edges 12 of the segments 10 or, as shown in FIG. 14, in the trim 20. Two recessed areas 40 in adjacent segments 10 form a continuous recess across the hinge area 9 when the segments are in an unfolded condition, as shown in FIGS. 1 and 15. The locking apparatus 30 further includes a sliding bar 42 which fits within the recessed areas 40. At least one of each two adjacent recessed areas 40 is sufficiently long enough to receive the entire length of the sliding bar 42. The sliding bar 42 is sufficiently long to simultaneously extend across the hinge area 9 and a desired longitudinal length of the two adjacent segments 10 such that the sliding bar securely locks the adjacent segments relative to each other. The sliding bar 42 is slid into the sufficiently long recessed area 40, such that the sliding bar does not cross the hinge area 9, to permit folding of the segments 10.

Figure 16:
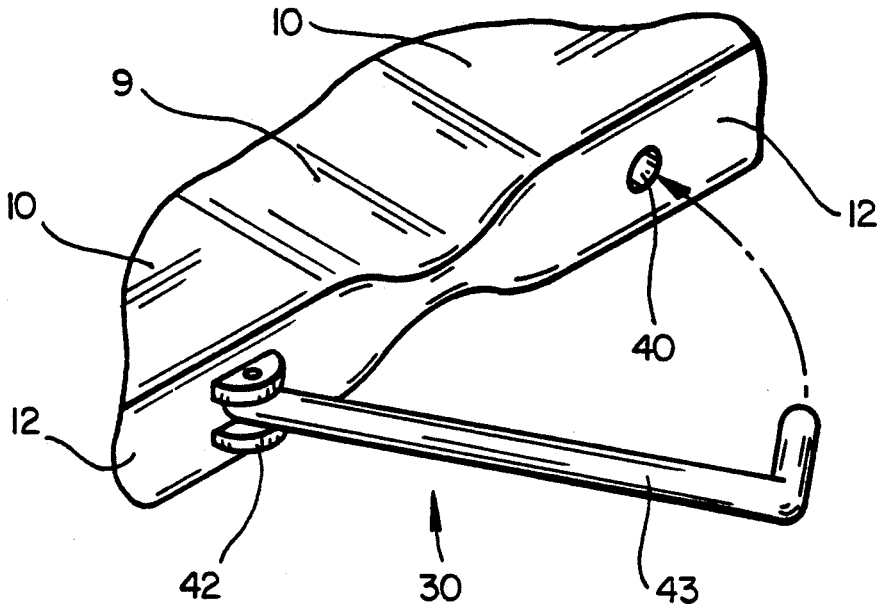
FIG. 16 is a perspective view of a locking structure according to an embodiment of the present invention.

With reference to FIG. 16, another embodiment of a locking apparatus 30 includes a recessed area 40 in a longitudinal edge 12 of a segment 10. A longitudinal edge 12 of an adjacent segment 10 is provided with a pivotable bar 43. When the segments 10 are in an unfolded condition, the bar 43 is pivotable across a hinge area 9 and an end of the bar is received in the recessed area 40 to lock the segments relative to one another. The bar 4 is removed from the recessed area 40 to fold the segments 10. The bar 43 may also be formed as a hook and may mate with a ring (not shown) on the other segment.

Figure 17:
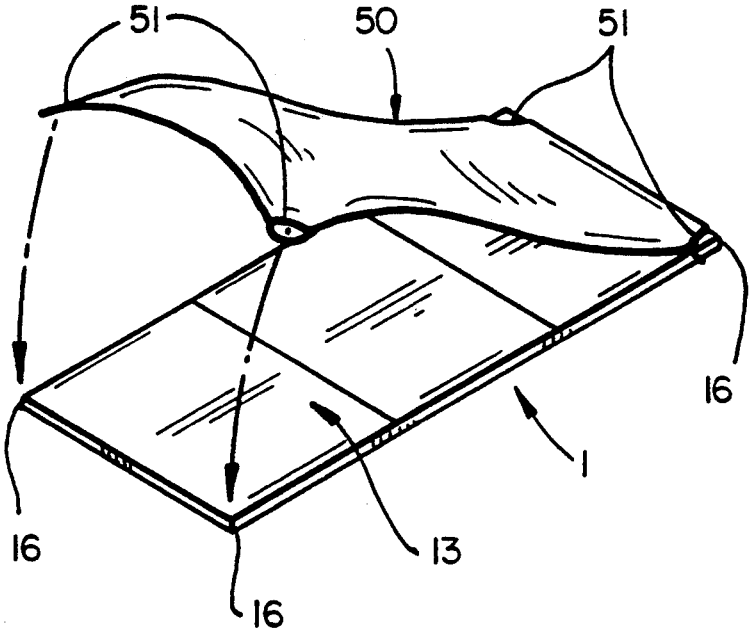
FIG. 17 is a perspective view of a patient support surface and a patient transfer sheet according to an embodiment of the present invention.

With reference to FIG. 17, a patient support surface 1 is provided with a patient transfer sheet 50. The patient transfer sheet 50 is substantially rectangular and is substantially the same size as the planar support surface 13. The patient transfer sheet 50 is provided with four corners 51 adapted to be attached to the corners 16 of the planar support surface 13 to secure a load being carried on the planar support surface. The corners 51 are preferably formed in the shape of handles such that the handles fit over the corners 16 of the planar support surface 13. The corners 51 may, alternatively, comprise snap portions (not shown) for mating with corresponding snap portions on the corners 16 of the planar support surface, or be provided with elastic bands for fitting the patient transfer sheet 50 around the planar support surface 13.

As noted above, the patient support surface 1 may comprise a single segment 10. In such a patient support surface, a rectangular planar support surface may be formed with hand holds, discussed above, and may comprise fiber reinforced composite material. The patient support surface of this embodiment has sufficient integral transverse strength to support a patient when the support surface is carried or suspended by the longitudinal edges. Such a patient support surface is of a sufficiently light weight to enable practical hand lifting of the patient support surface and the patient. The composite structure may comprise reinforcing fibers oriented to provide higher rigidity and lower flexibility in, say, a transverse direction than a longitudinal direction, or vice versa.

A patient support surface 1 may comprise a planar support surface and integral bracing means for bracing the planar support surface in a transverse and a longitudinal direction formed of a laminate including load bearing skin layers 2, 5. A portion of the planar support surface is formed of a sandwich laminate comprising two load bearing skin layers being separated by a core 8 in contact with the interior surfaces of the load bearing skin layers. One or both of the load bearing skin layers 2, 5 are formed of a composite material formed with oriented fibers. The core 8 may be of a honeycomb material and may be flexible.

It is, of course, possible to embody the invention in specific forms other than those described above without departing from the spirit of the present invention. The embodiments described above are merely illustrative and should not be considered restrictive in any way. The scope of the invention is given in the appended claims, rather than the preceding description, and all variations and equivalents which fall within the range of the claims are intended to be embraced therein.

What is claimed is:

1. A multipurpose patient support surface, comprising:

a first substantially rectangular support surface segment having first and second transverse edges and two longitudinal edges, a second substantially rectangular support surface segment having first and second transverse edges and two longitudinal edges, the first transverse edge of the first support surface segment facing the first transverse edge of the second support surface segment, said first and second support surface segments being rigid in a transverse and a longitudinal direction;

connecting and folding member for connecting the first transverse edge of said first support surface segment to the first transverse edge of said second support surface segment and for permitting the first support surface segment to be folded relative to the second support surface segment in a longitudinal direction, the connecting and folding member comprising a flexible hinge material that is located between, in contact with and, covers substantially the entire facing first transverse edges of the first support surface segment and the second support surface segment, said flexible hinge material isolating the first transverse edges of the first and second support surface segments from a surrounding exterior environment during folding of the first and second support surface segments; and means for locking the first support surface segment relative to the second support surface segment to prevent said first and second support surface segments from being folded with respect to one another and thereby form a substantially planar support device, the planar support device having a top and a bottom planar surface, four corners, and a periphery;

wherein at least a portion of each support surface segment is formed of a laminate including a top and a bottom load bearing skin layer each having exterior and interior surfaces, and wherein at least a portion of each support surface segment is formed of a sandwich laminate comprising the top and bottom load bearing skin layers being separated by a core in contact with the interior surfaces.

2. A multipurpose patient support surface as set forth in claim 1, wherein the connecting and folding member comprises portions of the interior surfaces of the top and bottom skin layers being sealed together in an area that is devoid of said core so that the first support surface segment can be folded relative to the second transverse segment in the sealed area.

3. A multipurpose patient support surface as set forth in claim 1, wherein the core is disposed adjacent only an outer peripheral region of the planar support device so that a central region between the top and bottom load bearing skin layers of each support surface segment being devoid of a core.

4. A multipurpose patient support surface as set forth in claim 1, wherein the core is formed of a composite honeycomb material.

5. A multipurpose patient support surface as set forth in claim 1, wherein the core is formed of an expanded or foamed composite material.

6. A multipurpose patient support surface as set forth in claim 1, wherein the skin members are formed of a composite material.

7. A multipurpose patient support surface as set forth in claim 6, wherein the skin layers comprise fiber reinforcing elements oriented to provide flexibility in the longitudinal direction and rigidity in the transverse direction.

8. A multipurpose patient support surface as set forth in claim 7, wherein the locking means extends substantially the entire length of the longitudinal edges of the first and second support surface segments to provide longitudinal rigidity to substantially the entire length of the planar patient support device.

9. A multipurpose patient support surface as set forth in claim 1, wherein the locking means comprise a longitudinal recessed area that extends between the core of the first support surface segment and the core of the second support surface segment, the recessed area crossing the connection at the first transverse edges of the first and second support surface segments, and a rigid bar, the rigid bar being receivable in and longitudinally slidable in the recessed area, a portion of the recessed area in the core of at least one of the first and second support surface segments being at least as long as the bar.

10. A multipurpose patient support surface as set forth in claim 1, wherein the locking means comprise a plurality of lock out sliders in the form of a rigid C-shaped tubular member, the lock out sliders being positioned over oppositely positioned longitudinal edges of the first and second support surface segments, the lock out sliders further being longitudinally slidable across the connection at the first transverse edges of the first and second support surface segments.

11. A multipurpose patient support surface as set forth in claim 1, wherein the locking means comprise a recessed area in the core of the second support surface segment, and a rigid bar pivotably attached to the core of the first support surface segment, the rigid bar being pivotable into and out of the recess in the core of the second support surface segment.

12. A multipurpose patient support surface as set forth in claim 1, further comprising a patient transfer sheet for being removably attached to the planar support device to hold a patient in position on the top surface of the planar support device, the patient transfer sheet being substantially rectangular and substantially as large as the top surface of the planar support device, the patient transfer sheet having four corners formed to attach over the four corners of the planar support device for holding the patient transfer sheet in position relative to the planar support device.

13. A multipurpose patient support surface as set forth in claim 12, wherein the corners of the patient transfer sheet are formed as handles.

14. A multipurpose patient support surface as set forth in claim 1, wherein the periphery of the planar support device includes recesses forming strap receiving areas.

15. A multipurpose patient support surface as set forth in claim 1, wherein the first transverse edge of the first support surface segment is spaced from the first transverse edge of the second support surface segment, the flexible hinge material being secured to oppositely facing surfaces of the first and second support surface segments.

16. A multipurpose patient support surface as set forth in claim 1, wherein the flexible hinge material includes a portion of reduced thickness located intermediate said first transverse edges of said first and second support surface segments to facilitate folding of first and second support surface segments.

17. A multipurpose patient support surface, comprising:

a rectangular planar support surface structure having longitudinal edges, an outer peripheral region and hand-hold means integrally formed therein for lifting the planar support surface structure by hand, said planar support surface structure having oppositely facing upper and lower surfaces, the entire upper surface of said planar support surface structure extending to the outer peripheral region being located in a common plane, the entire lower surface of said planar support surface structure extending to the outer peripheral region being located in a common plane, said planar support surface structure being comprised of two skin layers and a core with planer upper and lower surfaces positioned between the two skin layers, each of the skin layers being comprised of a fiber reinforced composite material, the core being secured to the two skin layers and being located adjacent only outer peripheral regions of the two skin layers so that a central region between said two skin layers is devoid of the core, the support surface structure having sufficient integral transverse strength to support a patient when the support surface structure is carried or suspended by at least portions of the longitudinal edges thereof; and wherein the composite material provides said support surface structure having said strength and possesses a sufficiently light weight to enable practical hand lifting thereof with a patient thereon.

18. A multipurpose patient support surface as set forth in claim 17, wherein the fibers in the composite are oriented to provided desired strength properties.

19. A multipurpose patient support surface as set forth in claim 18, wherein the fibers are oriented to provide higher rigidity and lower flexibility in a transverse direction than in a longitudinal direction.

20. A multipurpose patient support surface as set forth in claim 19, wherein the support surface structure comprises at least two separate segments, and hinge means for connecting said two segments to one another and for allowing said two segments to be folded relative to one another so that one segment is stacked on the other segment.

21. A multipurpose patient support surface as set forth in claim 20, wherein the hinge means includes said two skin layers being in contact and sealed to one another in an area that is devoid of said core so that the two segments can be folded with respect to one another in the sealed area.

22. A multipurpose patient support surface as set forth in claim 20, wherein the hinge means comprises a flexible material connected to the two segments and located between facing transverse edges of the two segments, the flexible material having a portion of reduced thickness to facilitate folding of the two segments.

23. A multipurpose patient support surface as set forth in claim 17, wherein the structure is adapted for use in a magnetic resonance imaging device.

24. A multipurpose patient support surface as set forth in claim 23, wherein the structure is translucent for use in an x-ray device.

25. A multipurpose patient support surface as set forth in claim 17, wherein the structure is radio translucent for use in an x-ray device.

26. A multipurpose patient support surface, comprising:

a planar support device having a top and a bottom planar surface, four corners, and a periphery, the entire top surface of said support device extending to the periphery lying in a common plane, the entire bottom surface of said support device extending to the periphery lying in a common plane;

integral strengthening means for strengthening the planar support device in a transverse direction and in a longitudinal direction; and at least a portion of the strengthening means being comprised of a laminate that includes load bearing skin layers having exterior and interior surfaces, and including a core with planar upper and lower surfaces positioned between and in contact with the interior surfaces of the skin layers, said core comprising a plastic foam material positioned adjacent only an outer periphery of the skin layers so that a central region between said skin layers is devoid of said core, each of said skin layers having an outer peripheral region, the entire exterior surface of each skin layer lying in a common plane.

27. A multipurpose patient support surface as set forth in claim 26, wherein one of the load bearing skin layers is formed of a composite material formed with oriented fibers.

28. A multipurpose patient support surface as set forth in claim 26, wherein the core is formed of a honeycomb material.

29. A multipurpose patient support surface as set forth in claim 26, wherein the core material is flexible.

30. A multipurpose patient support surface, comprising:

a first substantially rectangular support surface segment having two transverse edges and two longitudinal edges, and a second substantially rectangular support surface segment having two transverse edges and two longitudinal edges, the first and second support surface segments being rigid in a transverse and a longitudinal direction;

folding and connecting member for connecting the first and second support surface segments to one another along facing transverse edges and for permitting the first support surface segment to be folded relative to the second support surface segment, in a longitudinal direction, the folding member comprising flexible hinge material that is located between, in contact with and, covers substantially the entire facing transverse edges of the first support surface segment and the second support surface segment so that the facing transverse edges of the first and second support surface segments are spaced apart from one another with the flexible material located therebetween, the flexible hinge material having flexibility sufficient to allow the first and second support surface segments to be folded relative to one another, the flexible hinge material being disposed relative to said facing transverse edges of the first and second support surface segments so as to isolate said facing transverse edges from a surrounding outside environment; and means for locking the first support surface segment in coplanar relation to the second support surface segment to form a substantially planar support surface structure having a top and a bottom planar surface, four corners, and a periphery;

wherein at least a portion of each support surface segment is formed of composite material comprising fiber reinforcing elements oriented to provide rigidity in one direction and flexibility in another direction.

31. A multipurpose patient support surface as set forth in claim 30, wherein each support surface segment is comprised of two skin layers fabricated of said composite material and a core positioned between said two skin layers, said core being positioned adjacent only a peripheral region of the two skin layers so that a central region between said two skin layers is devoid of said core, said flexible hinge material being attached to oppositely facing surfaces on each of the first and second support surface segments, said flexible hinge material having a portion of reduced thickness to facilitate folding of the first and second support surface segments.

32. A multipurpose patient support surface as set forth in claim 30, wherein each support surface segment is comprised of two skin layers fabricated of said composite material and a core positioned between said two skin layers, said core being positioned adjacent only a peripheral region of the two skin layers so that a central region between said two skin layers is devoid of said core, said flexible hinge material comprising said two skin layers being in contact and sealed to one another in an area that is devoid of said core and in an area that is located between said facing transverse edges so that the first and second support surface segments can be folded with respect to one another in the sealed area.

* * * * *